US007959006B2

(12) United States Patent
McCoy et al.

(10) Patent No.: US 7,959,006 B2
(45) Date of Patent: Jun. 14, 2011

(54) BAG WITH ELASTIC SUPPORT MEMBERS

(75) Inventors: Ryan McCoy, Falcon Heights, MN (US); Daniel Joseph Hoyord, St. Paul, MN (US); Angela L. Baer, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 309 days.

(21) Appl. No.: 12/275,603

(22) Filed: Nov. 21, 2008

(65) Prior Publication Data

US 2010/0129007 A1 May 27, 2010

(51) Int. Cl.
*B65D 1/34* (2006.01)
*B65D 6/04* (2006.01)

(52) U.S. Cl. ..... 206/554; 206/806; 383/8; 383/22; 383/24; 383/37

(58) Field of Classification Search ..... 206/554, 206/806; 383/9, 37, 8, 22, 24
See application file for complete search history.

(56) References Cited

U.S. PATENT DOCUMENTS

| | | | | | |
|---|---|---|---|---|---|
| 4,493,419 | A * | 1/1985 | Prader et al. | 206/554 |
| 4,570,820 | A * | 2/1986 | Murphy | 221/34 |
| 4,785,938 | A * | 11/1988 | Benoit et al. | 206/554 |
| 5,265,961 | A | 11/1993 | Boyd | 383/75 |
| 5,465,845 | A * | 11/1995 | Norby et al. | 206/554 |
| 5,569,348 | A * | 10/1996 | Hefele | 156/239 |
| 6,190,045 | B1 * | 2/2001 | Schulman | 383/24 |
| 6,585,415 | B2 | 7/2003 | Malaspina | 383/75 |
| 6,921,202 | B2 | 7/2005 | Raterman | 383/33 |
| 6,994,469 | B2 | 2/2006 | Sleight et al. | 383/43 |
| 7,300,395 | B2 | 11/2007 | Sleight et al. | 493/215 |
| 2004/0086205 | A1 | 5/2004 | Raterman | 383/33 |
| 2004/0208397 | A1 | 10/2004 | Yi | 383/15 |
| 2005/0047685 | A1 | 3/2005 | Tsutsumi | 383/8 |
| 2005/0207678 | A1 | 9/2005 | Gerena | 383/8 |
| 2007/0036472 | A1 | 2/2007 | Persenda | 383/33 |

* cited by examiner

*Primary Examiner* — Gregory Pickett
*Assistant Examiner* — Blaine G Neway
(74) *Attorney, Agent, or Firm* — Nixon & Vanderhye P.C.

(57) ABSTRACT

A bag has two handles extending from a containing structure that holds items. An elastic member is attached to each handle and each elastic member defines at least part of a passage. Arms of a bag rack assembly are placed through the passages defined by the elastic members so that the bag is supported on the bag rack by the elastic members.

10 Claims, 6 Drawing Sheets

BAG WITH ELASTIC SUPPORT MEMBERS

BACKGROUND

Disposable plastic shopping bags are widely used in retail stores. However, some concerns have been raised about the environmental impact of disposing large numbers of plastic bags in landfills. In response, reusable bags made of more durable materials have been introduced. However, the reusable bags that are currently available are not designed to be used with existing bag rack structures that are currently used to hold disposable plastic bags.

The discussion above is merely provided for general background information and is not intended to be used as an aid in determining the scope of the claimed subject matter.

SUMMARY

A shopping bag is provided that includes two handles and a carrying compartment. At the top of each handle, a loop of elastic material is provided that defines a passage. Arms on existing bag racks are inserted through the passages so that the bag is supported on the bag rack by the elastic material. In some embodiments, silicon rubber is included in the elastic material to keep the bag from slipping down the bag rack arm as the bag is filled.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments of the present invention provide a bag that has two handles extending from a containing structure that holds items. An elastic cord is attached to each handle and each elastic cord defines at least part of a passage. Arms of a bag rack assembly are placed through the passages defined by the elastic cords so that the bag is supported on the bag rack by the elastic cords. In some embodiments, the elastic cords include silicon rubber, which has a high coefficient of friction to limit movement of the bag on the bag rack during filling. The passages defined by the elastic cords allow a plurality of bags to be placed on the bag rack in the same orientation without twisting the handles on the bags. This makes it easier to load a large number of reusable bags on a bag rack at the same time.

Figure 1:
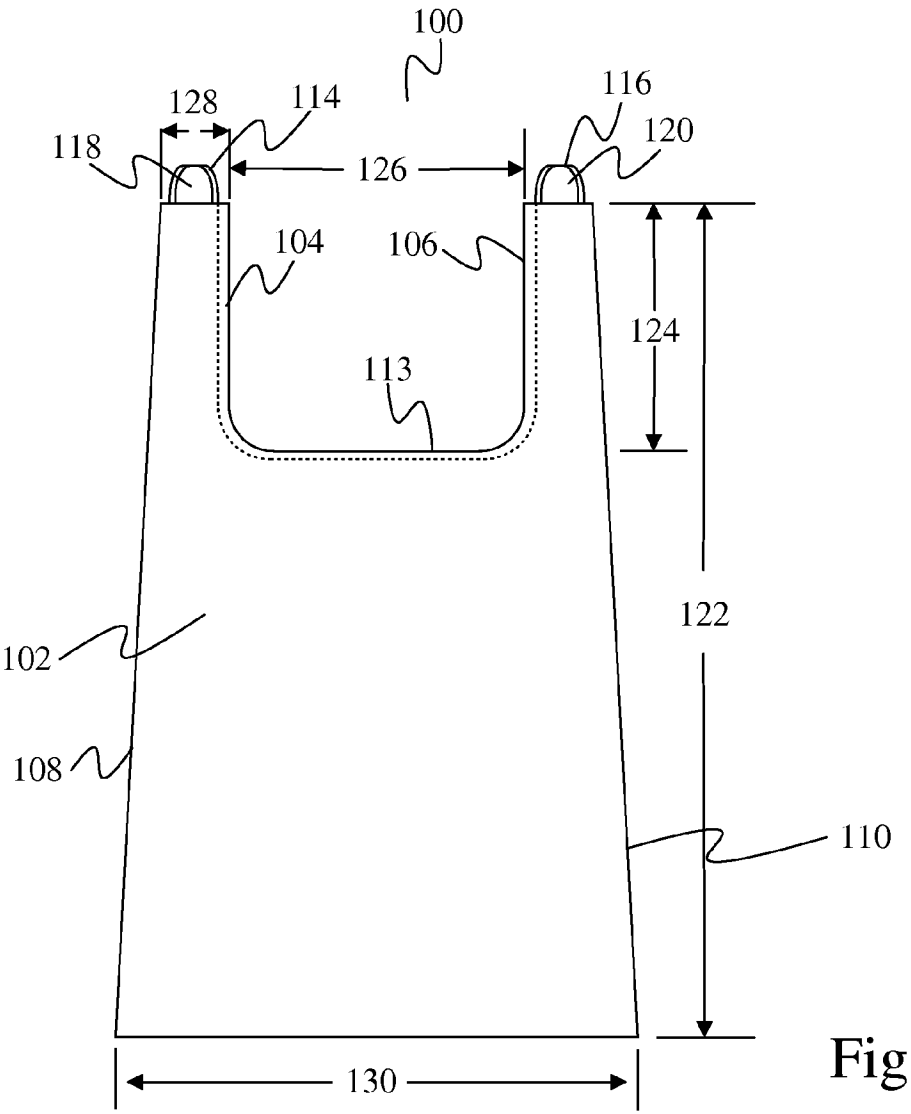
FIG. 1 is a front view of a bag under one embodiment.

FIG. 1 provides a front view of a bag 100 that includes a containing structure 102 and two handles 104 and 106. Containing structure 102 has two sealed sides 108 and 110 and a sealed bottom 112. The top 113 of containing structure 102 is open to allow items to be inserted and removed from bag 100. An elastic member 114 extends from handle 104 and an elastic member 116 extends from handle 106. Elastic member 114 and handle 104 define a passage or opening 118 and elastic member 116 and handle 106 define an opening or passage 120.

Bag 100 has an overall height 122 from bottom 112 to the top of handles 104 and 106. Under one embodiment, height 122 is about 24.5 inches. Handles 104 and 106 have a height 124 from the top of handles 104 and 106 to top 113 of containing structure 102. Under one embodiment, height 124 of handles 104 and 106 is about 6.5 inches. Handles 104 and 106 are separated by a width 126, which under one embodiment is about 8 inches and handles 104 and 106 have a width such as width 128 of handle 104, which under one embodiment is about 2 inches. The bottom of containing structure 102 has a width 130, which under one embodiment is about 13.5 inches.

Figure 2:
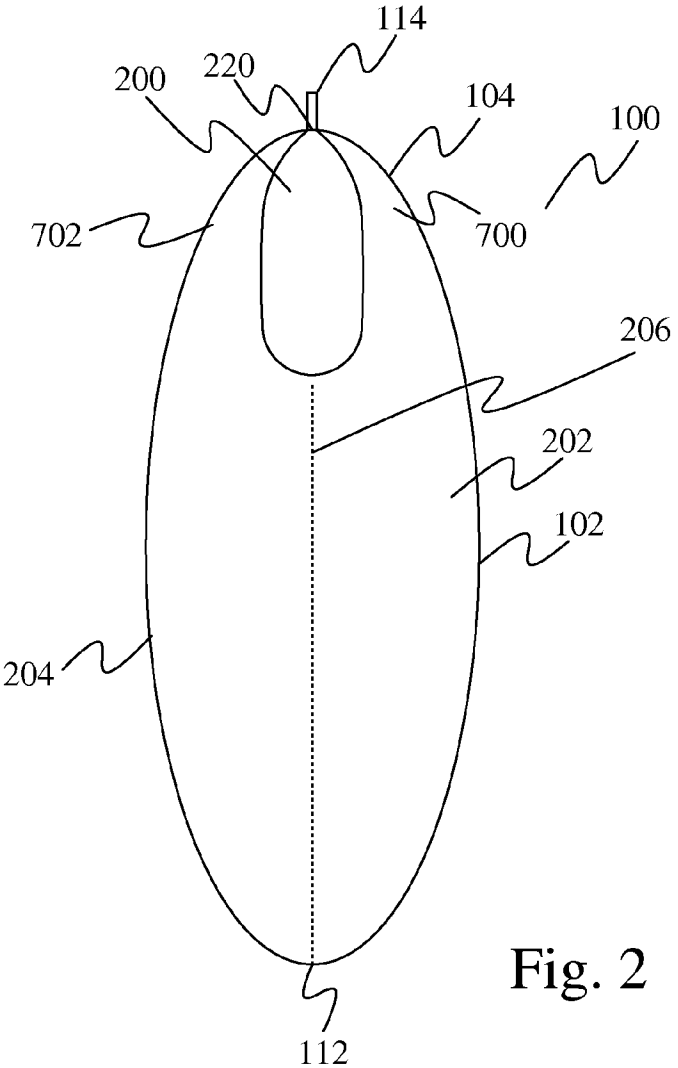
FIG. 2 is a side view of the bag in FIG. 1.

FIG. 2 shows a side view of bag 100 showing elastic member 114 extending from handle 104. Handle 104 defines a passage 200 that is designed to accommodate a person's hand. Bag 100 comprises two panels 202 and 204, which are connected together along the containing structure at a juncture 206 by a binding means. Examples of such binding means include stitching, adhesive, sonic welding, and the like, for example. The binding means may further include an intermediate panel between panels 202 and 204. As shown in more detail below, panels 202 and 204 are also attached together at a boundary 220 between a first handle portion 700 of panel 202 and a second handle portion 702 of panel 204 by binding means such as stitching, adhesive, sonic welding, and the like, for example. First handle portion 700 and second handle portion 702 extend from the containing structure to the boundary 220.

Figure 3:
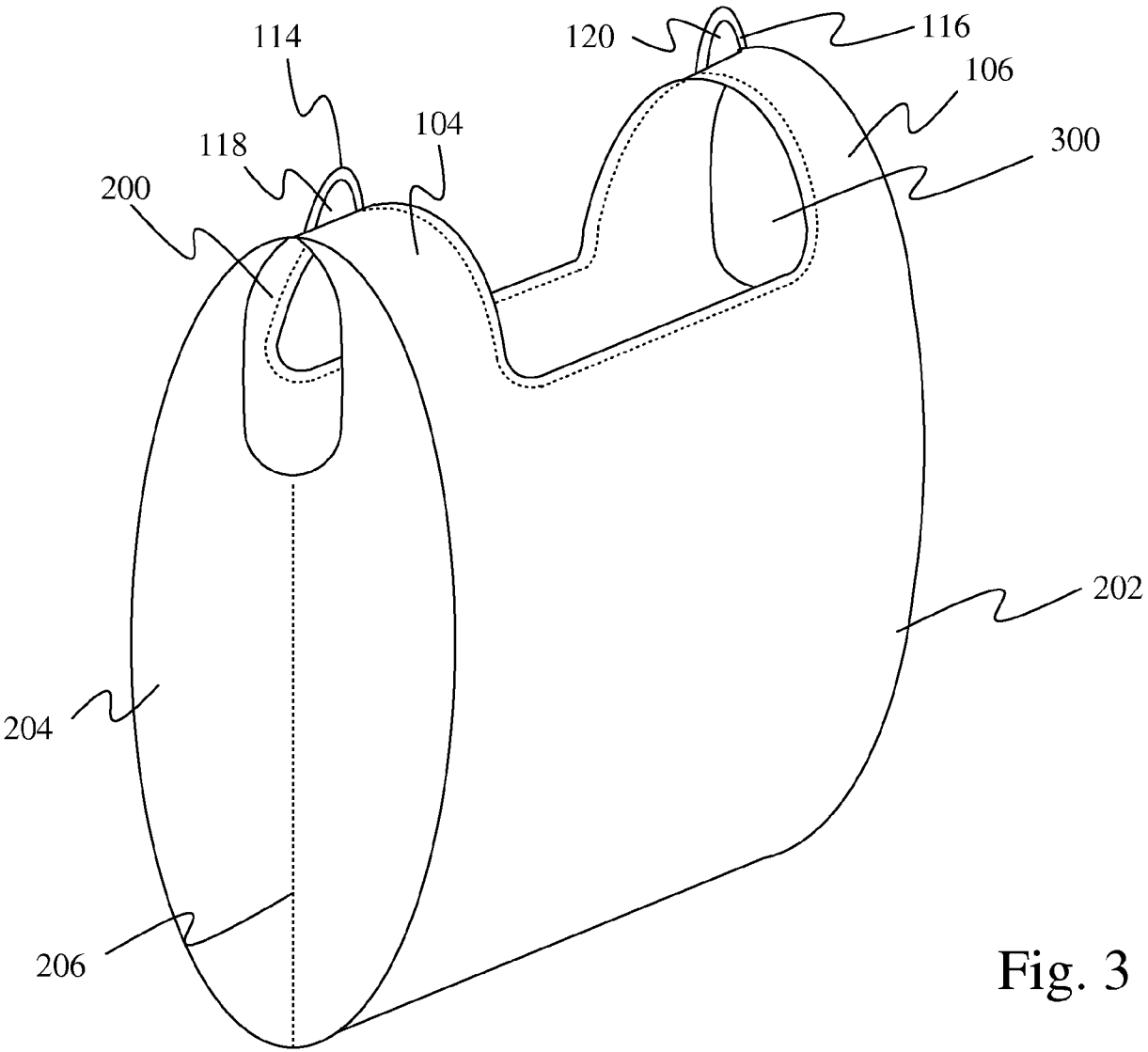
FIG. 3 is a perspective view of the bag of FIG. 1.

FIG. 3 provides a perspective view of bag 100. In FIG. 3, handle 106 is shown to define a passageway 300 designed to accommodate a person's hand.

Figure 4:
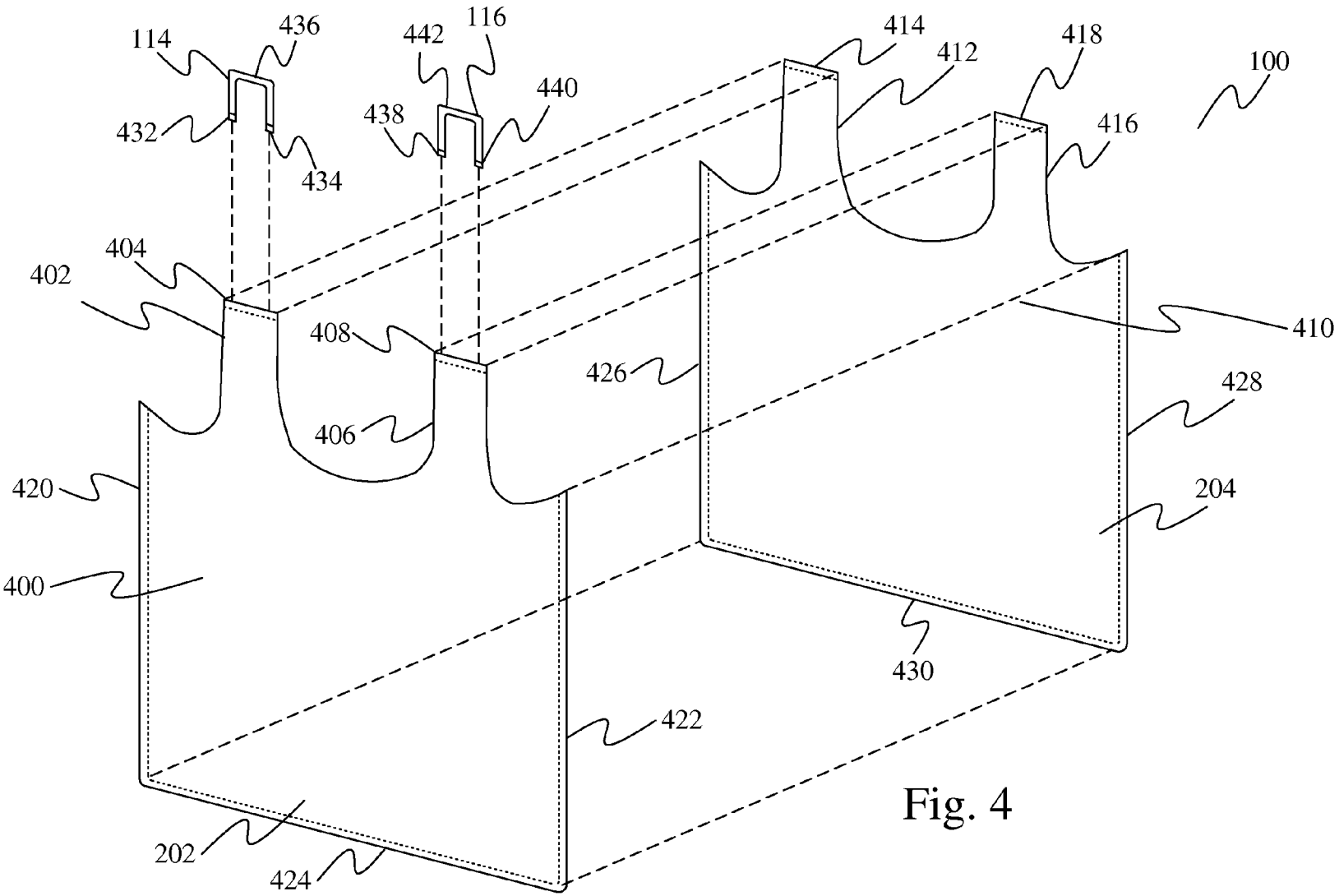
FIG. 4 is an exploded perspective view of the bag of FIG. 1.

FIG. 4 provides a perspective exploded view of bag 100. In FIG. 4, panel 202 includes a bag portion 400, first handle portion 402 extending from bag portion 400 and having an end 404 opposite bag portion 400 and a second handle portion 406 extending from bag portion 400 and having an end 408 opposite bag portion 400. Panel 204 includes a bag portion 410 and a first handle portion 412 extending from bag portion 410 and having an end 414 opposite bag portion 410. Panel 204 also includes a second handle portion 416 extending from bag portion 410 and having an end 418 opposite bag portion 410. Binding means attach side edges 420 and 422 of panel 202 to side edges 426 and 428, respectively, of panel 204. Binding means also attach bottom edge 424 of panel 202 to bottom edge 430 of panel 204. In addition, binding means attach end 404 of handle 402 to end 414 of handle 412 and binding means attach end 408 of handle 406 to end 418 of handle portion 416. Examples of binding means include stitching, adhesive, and sonic welding, for example.

Elastic member 114 includes two ends 432 and 434 that are both attached to end 404 of handle portion 402 and end 414 of handle portion 412. This attachment may be made using binding elements such as stitching, adhesive, or sonic welding, for example, that are distinct from elastic member 114. Under one embodiment discussed further below, ends 432 and 434 of elastic member 114 are attached to ends 404 and 414 through the same stitching used to attach end 404 of handle portion 402 to end 414 of handle portion 412. A portion 436 of elastic member 114 between end portions 432 and 434 extends above handle portions 402 and 412 and at least partially defines opening 118 (FIGS. 1 and 3).

Elastic member 116 includes ends 438 and 440 that are both attached to end 408 of handle portion 406 and end 418 of handle portion 416. This attachment may be made using binding elements such as stitching, adhesive, or sonic welding, for example, that are distinct from elastic member 116. Under one embodiment discussed further below, ends 438 and 440 of elastic member 116 are attached to ends 408 and 418 through the same stitching used to attach end 408 of handle portion 406 to end 418 of handle portion 416. Elastic member 116 also includes a portion 442 between ends 438 and 440 that extends above handle portions 406 and 416 and that defines, at least in part, opening 120 (FIGS. 1 and 3).

Panels 202 and 204 under one embodiment are formed from a woven material such as woven polypropylene. Other materials may be used such as woven cotton threads and non-woven materials, for example.

Although the embodiment of FIG. 4 shows a two-panel construction, in other embodiments additional panels may be present in the bag to provide a different shape to the bag.

Figure 5:
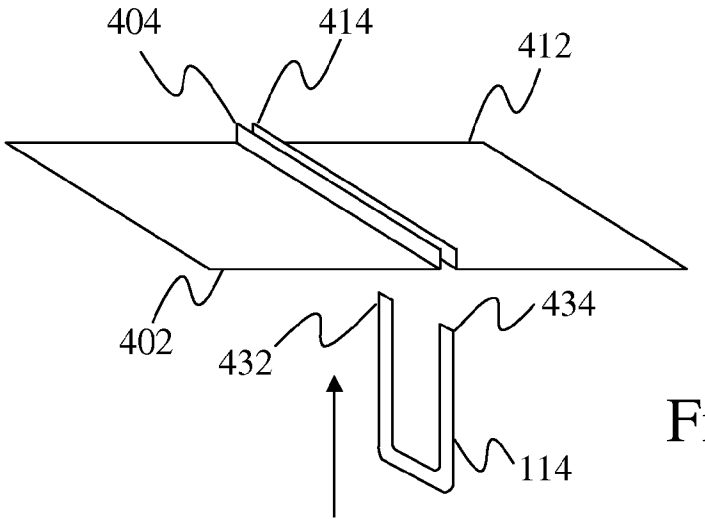
FIG. 5 provides a perspective view of the insertion of an elastic member between two handle portions during construction of a bag under one embodiment.

FIGS. 5, 6, 7, and 8 show various stages of attaching elastic member 114 between end 404 of handle portion 402 and end portion 414 of handle portion 412. In FIG. 5, ends 404 and 414 are folded relative to handle portion 402 and handle portion 418 and ends 432 and 434 of elastic member 114 are placed between ends 404 and 414.

Figure 6:
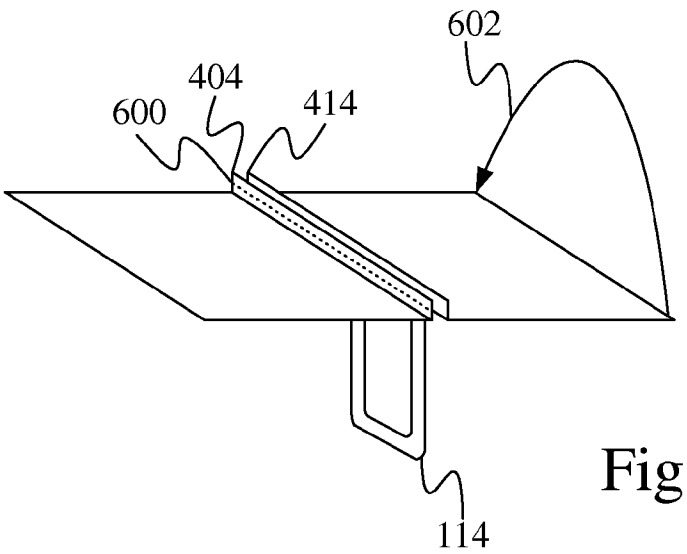
FIG. 6 provides a perspective view showing two handle portions and an elastic member stitched together during construction of a bag under one embodiment.
Figure 7:
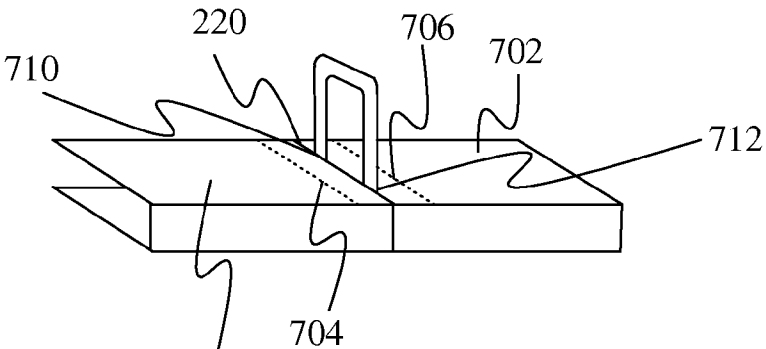
FIG. 7 shows a perspective view of two handle portions folded over and sewn together during construction of a bag under one embodiment.

In FIG. 6, stitching 600 is applied between ends 404 and 414 and through ends 432 and 434 of elastic member 114 thereby attaching elastic member 114, end 404 and end 414 together. Handle portions 402 and 412 are then folded in a direction 602 resulting in folded handle portions 700 and 702 of FIG. 7. As shown in FIG. 7, stitching 600 has formed boundary 220 between folded handle portions 700 and 702 and two points 710 and 712 of elastic member 114 are spaced apart along boundary 220. By attaching elastic member 114 in this position, it is possible to easily load a large number of bags on a bag rack without twisting the handles of the bag.

Stitching 704 is then applied to folded handle portion 700 and stitching 706 is applied to folded handle portion 702, where stitching 704 and 706 pass through the top and bottom of folded portions 700 and 702, respectively.

Figure 8:
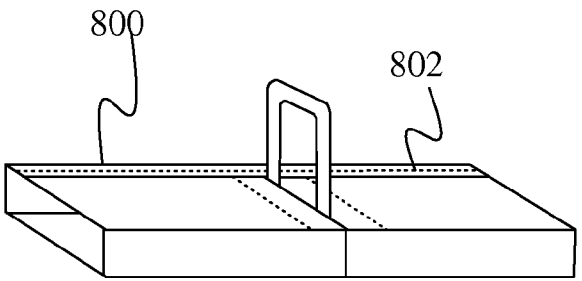
FIG. 8 provides a perspective view of edge binding added to two handle portions to form a complete handle during construction of a bag under one embodiment.

In FIG. 8, an edge binding 800 is wrapped around the free ends of folded portions 700 and 702 and stitching 802 is applied to edge binding 800 and the free ends of folded portions 700 and 702 to thereby close the free ends of folded portions 700 and 702.

Figure 9:
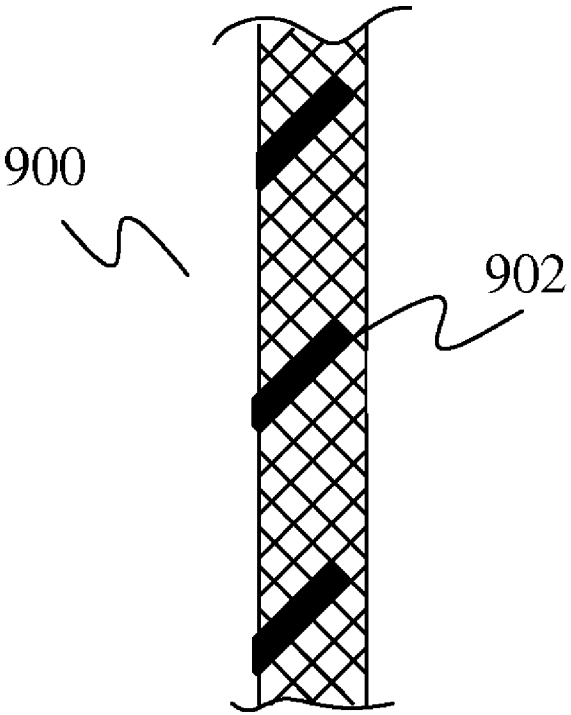
FIG. 9 provides and expanded view of a woven elastic member under one embodiment.

FIG. 9 provides an expanded side view of a portion of an elastic member 900, which is one embodiment of the elastic members 114 and 116. Elastic member 900 of FIG. 9 is formed of woven thread. One of the threads 902 is a silicon rubber thread. Silicon rubber thread 902 provides the elastic properties for elastic member 900. In addition, silicon rubber 902 has a high coefficient of friction that helps to prevent elastic member 900 from sliding on an arm of a bag rack when the elastic member is inserted on the arm of the bag rack. This helps to prevent the bag from slipping off the arm of the bag rack during filling. The other threads of elastic member 900 may be made of cotton or other natural fiber or may be formed of a synthetic fiber. In other embodiments, other materials with a high coefficient of friction are used in place of the silicon rubber.

Figure 10:
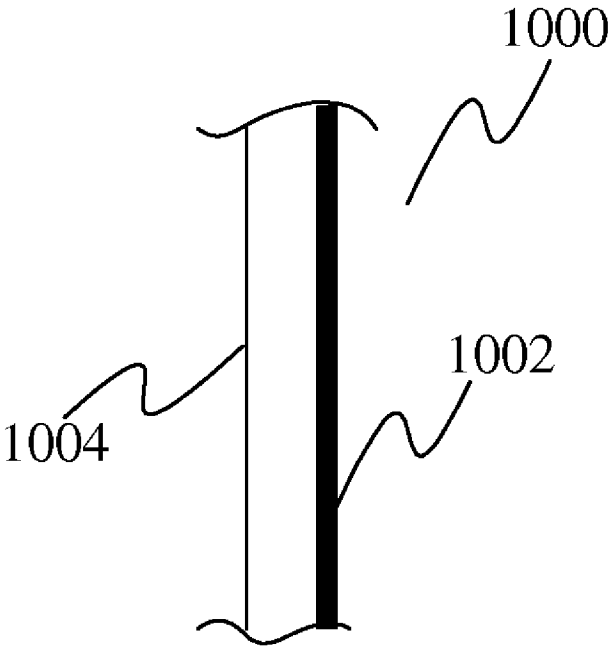
FIG. 10 provides and expanded side view of a silicon rubber tape embodiment of an elastic member under a second embodiment.

FIG. 10 provides an expanded side view of a portion of an elastic member 1000, which is another embodiment of elastic members 114 and 116. Elastic member 1000 of FIG. 10 includes a silicon rubber tape 1002 that has been bonded to a backing structure 1004. Under one embodiment, backing structure 1004 is a woven natural fiber structure such as woven cotton thread. In other embodiments, backing structure 1004 may be made of a synthetic material. In other embodiments, other materials with a high coefficient of friction are used in place of the silicon rubber.

Silicon rubber tape 1002 provides the elastic properties of elastic member 1000 and also provides a high coefficient of fiction to help prevent the bag from slipping down the arm of a bag rack assembly.

Figure 11:
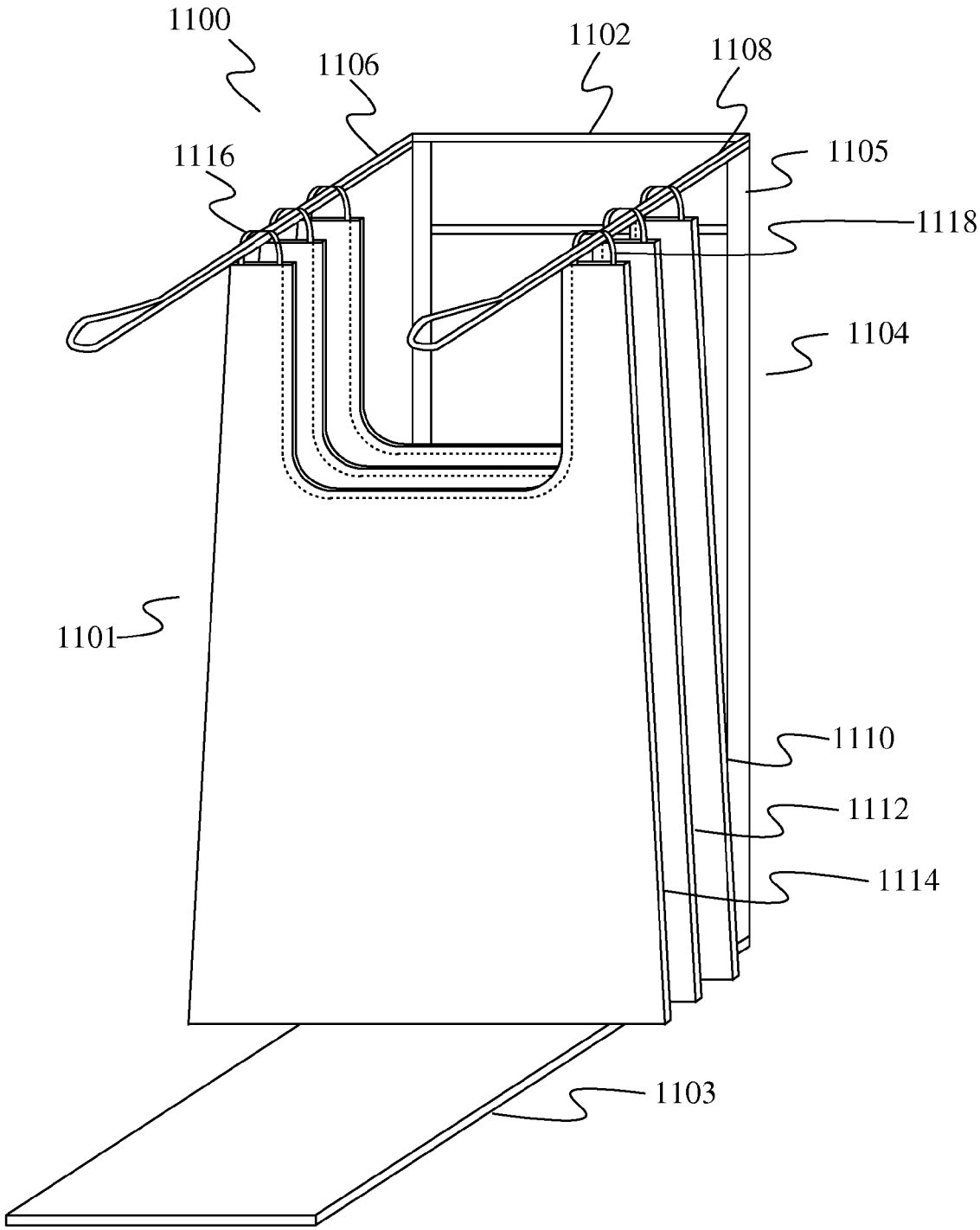
FIG. 11 provides a perspective view of a bag rack assembly including a plurality of bags.

FIG. 11 provides a perspective view of a bag rack assembly 1110 including a bag rack 1102 and a plurality of bags 1101. Bag rack 1102 has a base 1104 that includes a bottom support structure 1103, a vertical support structure 1105, first arm 1106, and a second arm 1108. First arm 1106 and second arm 1108 extend from vertical support structure 1105 of base 1104. Arms 1106 and 1108 go through the openings that are defined in part by the elastic members on bags 1110, 1112, and 1114. For example, arm 1106 goes through an opening that is defined in part by elastic member 1116 of bag 1114 and arm 1108 goes through an opening defined by elastic member 1118 on bag 1114. Under embodiments in which elastic members 1116 and 1118 include silicon rubber, the silconized rubber helps to prevent bag 1114 from moving down arms 1106 and 1108 as bag 1114 is filled. As shown in FIG. 11, the openings defined by the elastic members allow bags 1110, 1112 and 1114 to be placed on the bag rack in the same orientation without requiring twisting of the handles. This makes it easier to load a large number of bags on the bag rack at the same time.

In other embodiments, base 1104 does not include bottom support structure 1103 and vertical support structure 1105 extends downward from arms 1106 and 1108 a shorter distance. In such embodiments, vertical support structure 1105 is mounted to a wall.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A bag comprising:

a first panel having a bag portion, a first handle portion extending from and having an end opposite the bag portion of the first panel and a second handle portion extending from and having an end opposite the bag portion of the first panel;

a second panel having a bag portion, a first handle portion extending from and having an end opposite the bag portion of the second panel and a second handle portion extending from and having an end opposite the bag portion of the second panel;

binding means for attaching the first panel to the second panel to define a bag having a first handle and a second handle;

a first elastic member attached to the end of the first handle portion of the first panel and the end of the first handle portion of the second panel, a part of the first elastic member being spaced from the ends of the respective first handle portions to define a passage between the first elastic member and the ends of the first handle portions; and a second elastic member attached to the end of second handle portion of the first panel and the end of the second handle portion of the second panel, a part of the second elastic member being spaced from the ends of the respective second handle portions to define a passage between the second elastic member and the ends of the second handle portions.

2. The bag of claim 1 wherein the first elastic member comprises a first portion attached to the end of the first handle portion of the first panel and the end of the first handle portion of the second panel, a second portion attached to the end of the first handle portion of the first panel and the end of the first handle portion of the second panel, and a third portion between the first portion and the second portion that defines at least part of the passage between the first elastic member and the ends of the first handle portions.

3. The bag of claim 2 wherein the first portion of the elastic member is attached to the end of the first handle portion of the first panel and the end of the first handle portion of the second panel by stitching through the end of the first handle portion of the first panel, the end of the first handle portion of the second panel and the first portion of the elastic member.

4. The bag of claim 1 wherein the first elastic member comprises a silicon rubber portion.

5. The bag of claim 4 wherein the silicon rubber portion comprises a silicon rubber thread.

6. The bag of claim 4 wherein the silicon rubber portion comprises a silicon rubber tape.

7. A bag rack assembly comprising:

a bag rack having a base, and a first arm and a second arm extending from the base;

a plurality of bags, each bag comprising first and second handles and a first passage defined at least in part by a first elastic piece extending above an end of the first handle and a second passage defined at least in part by a second elastic piece extending above an end of the second handle, wherein the first arm of the bag rack is positioned within each first passage of the plurality of bags and wherein the second arm of the bag rack is positioned within each second passage of the plurality of bags.

8. The bag rack assembly of claim 7 wherein the first elastic piece comprises a silicon rubber member and wherein the second elastic piece comprises a silicon rubber member.

9. The bag rack assembly of claim 7 wherein the first elastic piece of each bag extends from the first handle of each bag and the second elastic piece of each bag extends from the second handle of each bag.

10. The bag rack assembly of claim 9 wherein the first elastic piece comprises a first end attached to the first handle, a second end attached to the first handle, and an exposed portion that defines part of the first passage.

* * * * *